United States Patent [19]

Ullmann et al.

[11] Patent Number: 4,606,122

[45] Date of Patent: Aug. 19, 1986

[54] SHAVING HEAD FRAME WITH UP AND DOWN RAMPS

[75] Inventors: Roland Ullmann, Offenbach; Kurt Beutel, Flörsheim; Hans-Eberhard Heintke, Wächtersbach, all of Fed. Rep. of Germany

[73] Assignee: Braun Aktiengesellschaft, Kronberg, Fed. Rep. of Germany

[21] Appl. No.: 724,084

[22] Filed: Apr. 17, 1985

[30] Foreign Application Priority Data

Apr. 21, 1984 [DE] Fed. Rep. of Germany ..... 3415121

[51] Int. Cl.[4] ..... B26B 19/38

[52] U.S. Cl. ..... 30/43.92; 30/43.6

[58] Field of Search ..... 30/43.9, 43.92, 43.6, 30/43.1, 43

[56] References Cited

U.S. PATENT DOCUMENTS

| | | | |
|---|---|---|---|
| 2,246,586 | 6/1941 | Hanley | 30/43.92 |
| 2,561,241 | 7/1951 | Streng | 30/43.92 |
| 2,661,531 | 12/1953 | Streng | 30/43.92 |
| 2,734,266 | 2/1956 | Schreyer | 30/43.1 |
| 3,092,905 | 6/1963 | Duncan | 30/43.92 |
| 3,105,298 | 10/1963 | Carassimi | 30/43.92 |
| 3,191,299 | 6/1965 | Locke | 30/43.92 |
| 3,369,294 | 2/1968 | Shaw | 30/43.6 X |
| 3,999,291 | 12/1976 | Boer | 30/43.92 |
| 4,271,590 | 6/1981 | Ernst et al. | 30/43.92 |

FOREIGN PATENT DOCUMENTS 2519881 12/1975 Fed. Rep. of Germany .

*Primary Examiner*—Jimmy C. Peters

*Attorney, Agent, or Firm*—Raymond J. De Vellis

[57] ABSTRACT

Device for locking and unlocking a cutting head frame on the housing of a dry shaver, with up ramps and down ramps provided on the cutting head frame as guide means for locking elements located in the housing.

8 Claims, 4 Drawing Figures

SHAVING HEAD FRAME WITH UP AND DOWN RAMPS

BACKGROUND OF THE INVENTION

The invention relates to a dry shaver with a housing, a removable cutting head frame supporting the upper cutter, and a device for locking and unlocking the cutting head frame, composed of locking elements movably disposed in the housing, said elements, under spring tension, projecting from the narrow ends of the housing, and of operating elements disposed in the end cheeks of the cutting head frame and acting on the locking elements.

SUMMARY OF THE INVENTION

A dry shaver is known from German OS No. 25 19 811. The disadvantages of such a design consist in the fact that in order to overcome the lock, compressive forces and tensile forces directed in the opposite direction must be applied simultaneously to the cutting head frame and housing, with the additional complicating fact that the force components of the compressed locking springs tension the operating element via the locking element at right angles, thus imposing an unfavorable burden on the extraction process. Since the tensile forces to be applied to the cutting head frame and housing must be greater than the force components of the locking springs, the unlocking process proceeds discontinuously, which is perceived as unpleasant by the user.

The goal of the present invention is to provide a device for locking and unlocking a cutting head frame which does not suffer from the above disadvantages. The device is intended in particular to ensure that the cutting head frame is readily removable from or installable on, the housing.

This goal is achieved according to the invention by virtue of the fact that guiding up ramps are provided on the inside walls of the end cheeks toward the locking position of the locking elements, and that radially movable operating elements are disposed in the end cheeks, the walls of said elements acting on the locking elements and forming down ramps for the locking elements in the actuated state.

The up ramps provided on the inside walls of the end cheeks of the cutting head frame, leading to the locking position of the locking elements, facilitate the mounting of the cutting head frame on the housing by virtue of the fact that the locking elements are slid over a longer distance with a corresponding slope into the locking position, whereby the shoulders provided at the end of the up ramp and leading to the end cheeks can advantageously be used as locking stops for the locking elements.

The easy removability of the cutting head frame from the housing is achieved by the operating elements disposed in the end cheeks, said elements bending or rotating around their fastening point under the influence of pressure, and forming down ramps in this state, for the locking elements, which are forced out of the locking positions along with them in the course of this process. The operating elements which are forced into the cutting head frame abut the locking elements at an angle, so that the force component resulting from this angular position pushes the cutting head frame away from the housing by means of the down ramps.

The operating element preferably consists of a spring-tensioned or pivotably mounted lever arm disposed in a recess provided in the end cheek of the cutting head frame.

Advantageously, one end of the lever arm is fastened to a cross member provided in the recess, and has the end which acts on the locking element, abutting the inside wall of the end cheek in the resting position.

According to a preferred embodiment, the inside wall of the lever arm serves as a down ramp whose slope, according to the invention, during the actuation process of the lever arm, is determined as a function of its radial deflection.

Preferably, the slope of the down ramp of the lever arm can be changed by the locking action of the up ramp. The special advantage of this measure lies in the fact that the separation process of the cutting head frame and housing during the sliding of the locking elements along the down ramps of the lever arms can be accelerated by increasing the radial deflection of the lever arms and the resultant change in the ramp slope.

According to the invention, an up ramp is provided on both sides of an operating element on the end cheeks of the cutting head frame.

Preferably, the walls leading from the end of the slope of the down ramps to the inside walls are designed to serve as locking stops for the locking elements.

BRIEF DESCRIPTION OF THE DRAWINGS

Further advantages and details of the invention will be apparent from the following description and the drawings, in which a preferred embodiment is shown.

DESCRIPTION OF THE PREFERRED EMBODIMENT

Figure 1:
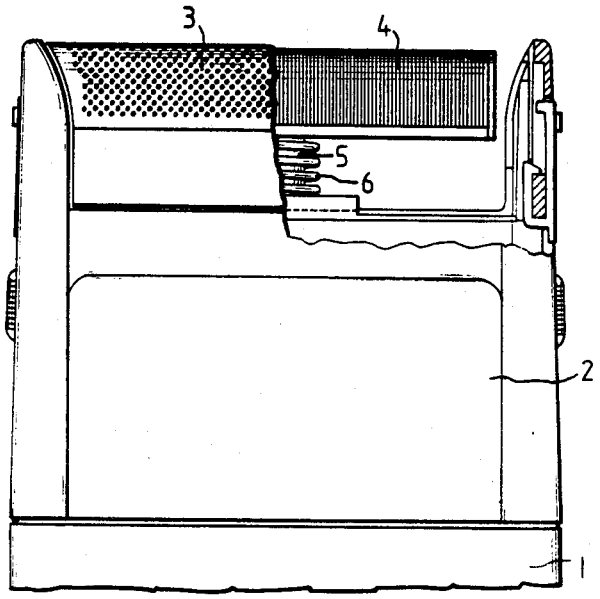
FIG. 1 shows a part of a shaver housing with a cutting head frame mounted thereon, in a front view and in partial section.

FIG. 1 shows a dry shaver with a cutting head frame 2 removable attached to a housing 1. An upper cutter 3 is fastened in cutting head frame 2, said cutter cooperating with a lower cutter 4, which is given a reciprocating motion via a swing lever 5 by a motor, not shown, disposed in housing 1. A coil spring 6 presses lower cutter 4 against upper cutter 3 in known fashion.

Figure 2:
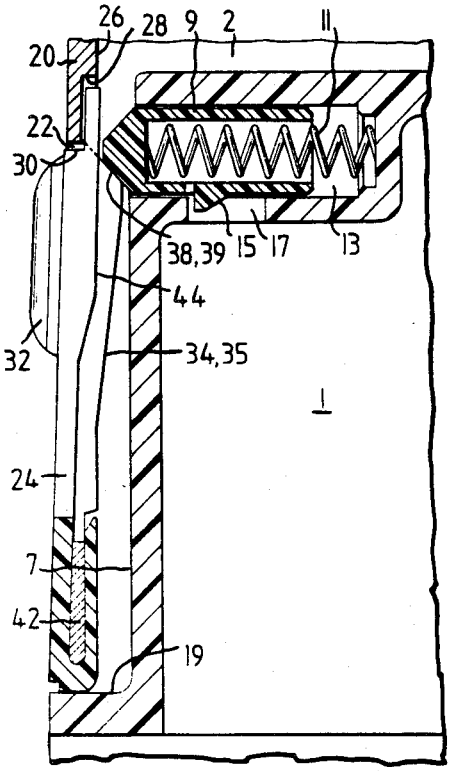
FIG. 2 is a lengthwise section through one of the two identical end cheeks of a cutting head frame as well as a partial section through the shaver housing in the vicinity of one of the two identically shaped locking elements.
Figure 3:
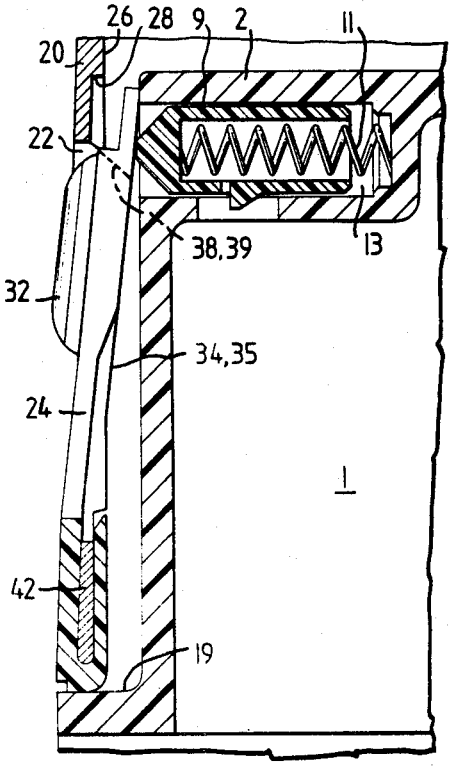
FIG. 3 is a lengthwise section and partial section as shown in FIG. 2, with one operating element in the operating state.
Figure 4:
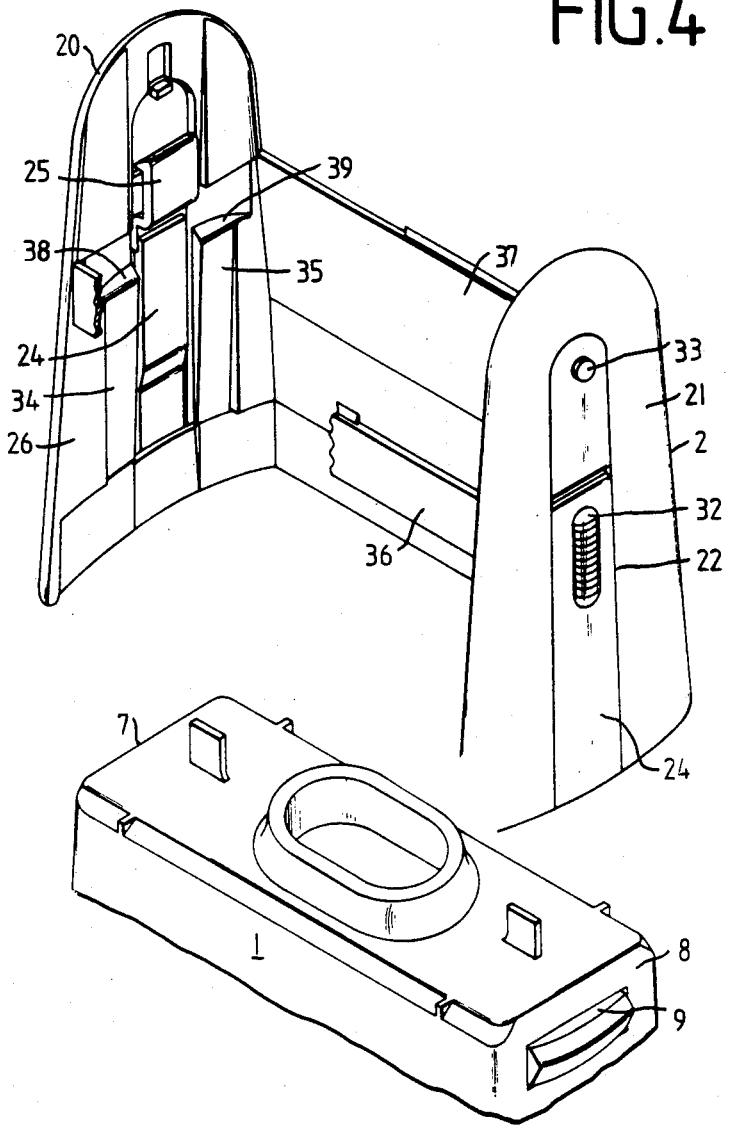
FIG. 4 is an exploded view of a cutting head frame as well as the upper part of a shaver housing in a perspective view.

As best seen in FIG. 4, ends 7 and 8 of housing 1 as well as end cheeks 20 and 21 of cutting head frame 2 are made identical, so that in the following, only one of the ends with one of the end cheeks will be referred to and described in detail. Locking elements 9 project from both ends 7 and 8 of housing 1, as shown in FIGS. 2, 3, and 4. As shown in FIG. 2, for example, locking elements 9, together with compression springs 11 acting on them, are disposed in recesses 13 in housing 1 and by means of spring-tensioned locking noses 15, which engage grooves 17 of predetermined length provided in the walls of recesses 13, are protected by the latter from falling out of recesses 13 and from rotating. The end of locking element 9 projecting from recesses 13 is made conical, whereby the apex of the cone can be flattened or rounded.

As best seen in FIGS. 2 and 3, the wall of housing 1 is offset slightly inward in the vicinity of cutting head frame 2, whereby a circumferential ledge 19 is formed, which serves as a stop for cutting head frame 2 when placed on housing 1.

Narrow U-shaped recesses 22, running lengthwise of the end cheeks and leading from the end of cutting head frame 2 resting on ledge 19, to the level of locking element 9, are provided in the two end cheeks 20 and 21 of cutting head frame 2. An operating element 24 in the form of an elongated button is disposed rotatably or, as shown, spring-tensioned, in each of recesses 22. For this purpose, a broad cross member 42 is provided in recesses 22, to which operating elements 24, made of springy material, are fastened, e.g. by a clip connection. Cross members 42 can also be made in the form of a round rod and mounted rotatably in the recesses to provide a rotatable stop, for rigidly designed operating elements for example.

Operating elements 24 have their ends away from ledge 19 abutting locking elements 9 and inside walls 26 of end cheeks 20 and 21, whereby operating elements 24 as well as inside walls 26 are provided in the contact area with interlocking shoulders 28 and 30.

Projections 32 are provided on operating elements 24, said projections projecting from recesses 22 and from the outer contour of end cheeks 20 and 21 when cutting head frame 2 and housing 1 are in the locked state. Projections 32 characterize the pressure range for the unlocking process for operating elements 24.

Up ramps 34 and 35 are formed with a predetermined slope on inside walls 26 on both sides of recesses 22 and parallel thereto. Up ramps 34 and 35 terminate in the vicinity of locking elements 9.

The return of the end of the slope of up ramps 34 and 35 to inside walls 26 produces shoulders which serve as locking stops 38 and 39 for locking elements 9, whereby these locking stops are provided with a bevel that matches the conical shape of locking element 9, which has a favorable effect on the unlocking and locking processes.

When operating elements 24 provided in end cheeks 20 and 21 are actuated by projections 32, the latter bend, sa shown in FIG. 3, radially inward around cross members 42 into cutting head frame 2, and force locking elements 9 against the pressure of springs 11 away from locking stops 38 and 39 into recesses 13. The walls of operating elements 24 acting on locking elements 9 then assume an inclined position corresponding to the radial deflection and thus form down ramps 44 for locking elements 9. If down ramps 44 and up ramps 34 and 35 are on the same plane, the unlocked locking elements 9 will glide along the down ramps under the influence of force components that result from the actuating pressure exerted on operating elements 24. Cutting head frame 2 then is lifted off ledge 19 of housing 1. Further bending of operating elements 24 during this downward sliding process causes the slope of the down ramps to increase, having an accelerating effect on the downward sliding process.

The unlocking process is initially reinforced and facilitated by the fact that in the locked state of cutting head frame 2 on housing 1, the available applied pressure of lower cutter 4 on upper cutter 3, fastened to cutting head frame 2, can be utilized in addition.

When cutting head frame 2 is placed on housing 1, operating elements 24 are in the position shown in FIG. 2, i.e., abutting the inside walls 26 of end cheeks 20 and 21. Cutting head frame 2 is slid over the recessed part of housing 1, whereby locking elements 9 come to rest abutting up ramps 34 and 35, whose constant slopes slide locking elements 9 against the pressure of compression springs 11 into recesses 13. After travelling past the ends of the slopes of up ramps 34 and 35, compression springs 11 force locking elements 9 partially out of recesses 13 into the locking position, whereby this process is reinforced by sloping locking stops 38 and 39 and the beveled areas provided on locking elements 9.

FIG. 4 shows a portion of housing 1 of the shaver, with a locking element 9 projecting from end 8, the ends of said element being beveled and running transversely to the end. An identically shaped locking element is provided in end 7. End cheeks 20 and 21 of cutting head frame 2 are joined together by a front wall 36, shown cut away, and a rear wall 37.

Two up ramps 34 and 35 are provided on inside wall 26 of end cheek 20, with a slope rising in the removal direction. The return of the up ramps to inside wall 26 produces locking stops 38 and 39, whose walls are beveled, corresponding to the bevels on the ends of locking elements 9, which abut these locking stops in the locking position. The springy or pivotable operating element 24 is disposed between the two up ramps 34 and 35 in a U-shaped recess, the end of said element pointing in the removal direction abutting either inside wall 26 of end cheek 20 or, as shown here, the non-movable foot part of another operating element 25.

End cheek 21, whose inside wall is not visible because of the perspective, has a design identical to the inside wall 26 of end cheek 20. This is also true of the outside walls of end cheeks 21 and 20 which show only the operating elements 24 and 25 with corresponding projections 32 and 33 running lengthwise of the end cheeks.

While an embodiment and application have been shown and described, it will be apparent that many more modifications are possible without departing from the inventive concepts herein described. The invention, therefore, is not to be restricted except as is necessary by the prior art and by the spirit of the appended claims.

What is claimed as new and desired to be secured by Letters Patent of the United States is:

1. A dry shaver comprising:

a housing having spring means and locking elements movably disposed in said housing to project from said housing under tension of said spring means;

a removable cutter head frame member for coupling to an outer cutter, said frame member having opposite end walls;

up guide ramp means on said end walls for guiding and locking with respect to said locking elements; and operating elements having an activated position and an at rest position, movably connected to said end walls and including down guide ramp means for guiding and unlocking with respect to said locking elements when said operating elements are in the activated position.

2. The dry shaver as in claim 1 wherein said end walls include an opening, and said operating elements each include a lever arm disposed in said opening.

3. The dry shaver as in claim 2 wherein said lever arms are spring tensioned.

4. The dry shaver as in claim 2 wherein each of said lever arms has a first and second end, said dry shaver further including cross members positioned in said openings and fastened to said first end of said lever arms, said second end of said lever arms cooperating with said locking elements of said housing when said operating elements are in the at rest position.

5. The dry shaver as in claim 4 wherein said down guide ramp means are located on said lever arms and the slope of said down ramp means is variable as a function of the radial deflection of said lever arms.

6. The dry shaver as in claim 5 wherein the slope of said down guide ramp means depends on the position of said up guide ramp means.

7. The dry shaver as in claim 2 wherein each of said up guide ramp means includes a first and second up ramp disposed on either side of said opening in said end walls.

8. The dry shaver as in claim 2 wherein each of said up guide ramp means includes a locking stop portion for cooperating with said locking elements.

* * * * *